United States Patent [19]

Tsunekawa et al.

[11] Patent Number: 4,982,063

[45] Date of Patent: Jan. 1, 1991

[54] DOOR LOCKING AND UNLOCKING APPARATUS FOR A COOKER USING ELECTROMOTIVE OPERATION AND MANUAL OPERATION

[75] Inventors: Takeshi Tsunekawa, Seto; Shunji Hiraoka, Nagoya; Kazuhiro Nishikawa, Oogaki, all of Japan

[73] Assignee: Kabushiki Kaisha Toshiba, Kawasaki, Japan

[21] Appl. No.: 298,984

[22] Filed: Jan. 19, 1989

[30] Foreign Application Priority Data

May 20, 1988 [JP] Japan ..... 63-123520

[51] Int. Cl.[5] ..... H05B 6/66

[52] U.S. Cl. ..... 219/10.55 C; 219/10.55 B; 219/10.55 D; 126/197; 292/92; 292/DIG. 65; 200/50 A

[58] Field of Search ..... 219/10.55 C, 10.55 B, 219/10.55 D; 126/197, 192; 292/21, 92, DIG. 65, DIG. 69; 70/283; 200/50 A, 50 C

[56] References Cited

U.S. PATENT DOCUMENTS

| | | | |
|---|---|---|---|
| 3,753,316 | 8/1973 | Savarieau et al. | 292/21 X |
| 3,784,776 | 1/1974 | Asanuma | 219/10.55 C |
| 4,522,359 | 6/1985 | Church et al. | 292/DIG. 65 |
| 4,638,137 | 1/1987 | Kazumi | 219/10.55 B |

FOREIGN PATENT DOCUMENTS 59-8724 2/1984 Japan .

*Primary Examiner*—Philip H. Leung

*Attorney, Agent, or Firm*—Cushman, Darby & Cushman

[57] ABSTRACT

A cooker includes a body having a heating compartment therein, and a door attached to the body to open and close the heating compartment. The door is locked in a closed position by a lock mechanism. When the door is to be opened, the lock mechanism is electromotively released by first release mechanism, or released by external mechanical force through a second release mechanism.

13 Claims, 6 Drawing Sheets

DOOR LOCKING AND UNLOCKING APPARATUS FOR A COOKER USING ELECTROMOTIVE OPERATION AND MANUAL OPERATION

BACKGROUND OF THE INVENTION

1. Field of the Invention

The present invention relates to a cooker, and more particularly, to a cooker the door of which can be opened electromotively.

2. Description of the Related Art

In recent years, a variety of cookers, such as microwave ovens, have been developed. In one such oven, as disclosed in Japanese Pat. Publication No. 59-8724, the door of the heating compartment is electromotively opened by operating a touch switch provided on a control panel.

In this type of microwave oven, the door can be opened by simply touching the switch, thus making the oven easy and convenient to use. The above device, however, has the disadvantage in that the door cannot be opened without electrical power. Therefore, foodstuff in the heating compartment cannot be taken out in the event of interruption in the power supply, for example. Moreover, since the microwave oven is generally not connected to a power supply when it is on display in a showroom, prospective purchasers therefore cannot open the door to inspect the heating compartment. In addition, when it is undergoing routine maintenance, such as inspection, repairs, door switch adjustment, etc., the oven is usually disconnected from the power supply for safety. In this case also, the door cannot be opened, which may hinder maintenance work being carried out.

SUMMARY OF THE INVENTION

The present invention has been developed in consideration of the above-mentioned matters, and has as its object to provide a cooker having a door which can be opened easily and assuredly, regardless of the state of electrical conduction of the cooker.

In order to achieve the above object, a cooker according to the present invention comprises a lock mechanism for locking a door in a closed position, first release means for electromotively releasing the lock mechanism, thereby allowing the door to be opened, and second release means for releasing the lock mechanism by means of external mechanical force, thus allowing the door to be opened.

According to the cooker constructed in this manner, the oven door can be unlocked for opening simply by touching, for example, a touch switch, to actuate the first release means, when power is on, and when the cooker is not connected to a power supply, the door can be unlocked for opening by operating the second release means.

BRIEF DESCRIPTION OF THE DRAWINGS

FIGS. 1 to 6 show a cooker according to a first embodiment of the present invention, in which FIG. 1 is a perspective view showing an outline of the cooker, FIG. 2 is a sectional view taken along line II—II of FIG. 1, FIG. 3 is a sectional view showing the principal part of a second release mechanism, FIG. 4 is a plan view showing the principal part of the second release mechanism, FIG. 5 is a circuit diagram showing a control circuit, and FIG. 6 is a sectional view showing a lock mechanism and the release mechanism in a state such that a door is unlocked; and FIGS. 7 to 10 show a cooker according to a second embodiment of the invention, in which FIG. 7 is a sectional view showing a lock mechanism and a release mechanism in a state such that a door is locked, FIG. 8 is a perspective view of a coupling lever, FIG. 9 is a sectional view taken along line IX—IX of FIG. 8, and FIG. 10 is a schematic view showing the coupling lever and an attachment tool used therewith.

DETAILED DESCRIPTION OF THE PREFERRED EMBODIMENTS

Preferred embodiments of the present invention will now be described in detail, with reference to the accompanying drawings.

Figure 1:
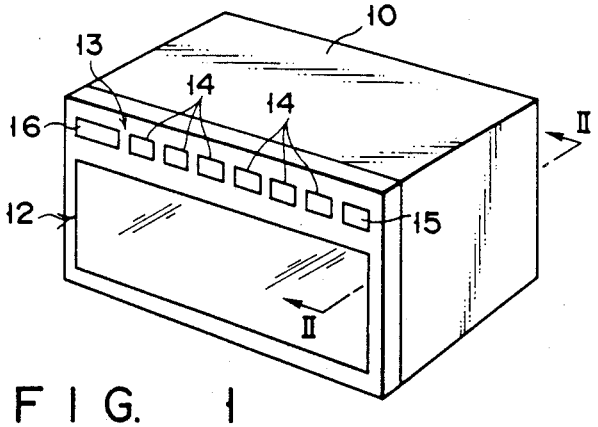
Figure 2:
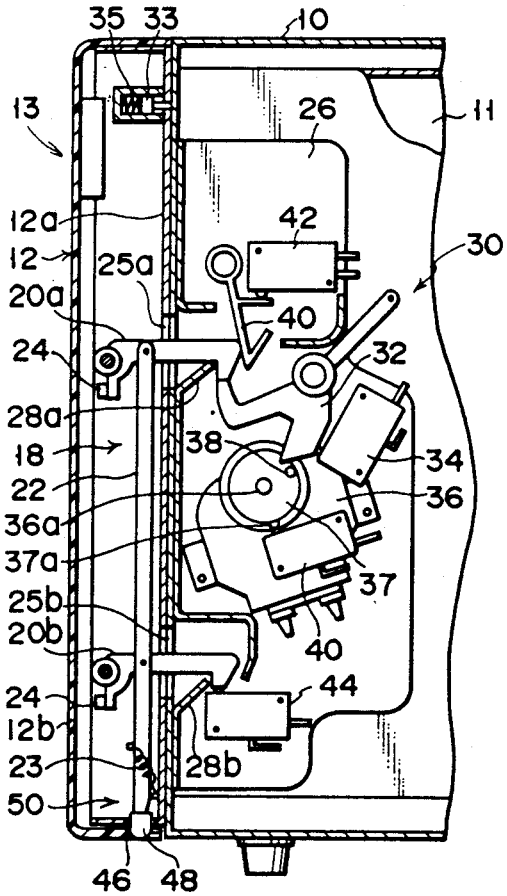

FIGS. 1 to 6 show an embodiment in which a cooker according to the present invention is applied to a microwave oven. As is shown in FIGS. 1 and 2, the microwave oven comprises box-shaped body 10 in which heating compartment 11 is defined. Door 12 for opening and closing compartment 11 is swingably attached, by its left-hand end portion (FIG. 1) to the front face of body 10 and is composed of metallic baseplate **12*a* and exposed faceplate 12*b* fixed to the baseplate. Control display panel 13, which is located at the top portion of door 12, is provided with touch setting keys 14 for setting various cooking conditions of the microwave oven, door open key 15, and indicator 16** for indicating the operating state of the oven.

As is shown in FIG. 2, the microwave oven additionally comprises lock mechanism 18 for locking door 12 in the closed position shown in FIG. 1. Lock mechanism 18 includes a pair of hooks **20*a* and 20*b* which are mounted on the right-hand end portion (FIG. 1) of door 12 and which serve as engaging members. The respective proximal ends of these hooks are supported on baseplate 12*a* of door 12 such that they are rockable within a vertical plane, the respective distal end portions of the hooks projecting from door 12 toward body 10. Vertically extending coupling lever 22 is arranged inside door 12, and the middle portion of each hook is rotatably connected to lever 22. Tension spring 23 is stretched between lever 22 and baseplate 12*a*, causing lever 22 to be urged downward. As a result, hooks 20*a* and 20*b* are always subjected to a clockwise rocking force from coupling lever 22, whereby they engage their corresponding stoppers 24. In this manner, the hooks are normally kept in the engaged position shown in FIG. 2**.

Insertion holes **25*a* and 25*b* are formed on the front side of body 10 such that they correspond positionally to hooks 20*a* and 20*b*, respectively. Lock board 26 is located vertically inside the front face of body 10, and has engaging pieces 28*a* and 28*b* arranged adjacent to holes 25*a* and 25*b*, respectively. Each engaging piece extends obliquely inward and upward, with respect to body 10, from the lower end edge of its corresponding insertion hole. As door 12 is closed, hooks 20*a* and 20*b* enter body 10 through holes 25*a* and 25*b*, respectively, whereupon, a bent portion at the extreme end of each hook moves, sliding on the slope of the corresponding engaging piece (28*a*/28*b*) and rocking counterclockwise against the urging force of spring 23. When the respective bent portions of hooks 20a and 20b pass the upper end edges of their corresponding engaging pieces, the hooks are rocked clockwise by the urging force of spring 23, so that the bent portions engage the upper end edges of the engaging pieces. In this manner, door 12** is locked in the closed position.

First release mechanism 30 for electromotively unlocking door 12 is provided on lock board 26. More specifically, mounted on board 26 are rockable push lever 32 in the vicinity of engaging piece 28a, and first address switch (microswitch) 34 beside lever 32. When door 12 is closed, lever 32 is pushed by hook 20a, thereby rocking counterclockwise to press the actuator of switch 34. When door 12 is to be opened, as will be described later, push lever 32 is pushed by pin 38, thereby rocking clockwise to force up hook 20a.

Motor 36 is mounted on board 26 such that it is situated below lever 32. Disk-shaped cam 37 is attached to rotating shaft 36a of motor 36, and has a projection 37a for position detection formed on its peripheral surface, and a pin 38 protruding from its front face in a direction perpendicular to the plane of FIG. 2. Also, position detection switch (microswitch) 40 is mounted on motor 36 adjacent to the peripheral surface of cam 37. When motor 36 is actuated to open door 12, cam 37 rocks in the counterclockwise direction, whereupon, pin 38 on cam 37 presses push lever 32, thereby rocking the lever in the clockwise direction.

On board 26 are mounted shift lever 40 and door monitor switch (microswitch) 42, situated above push lever 32. When door 12 is closed, lever 40 is pushed by hook 20a, to thereby press the actuator of switch 42. Second door switch 44 is provided on the lower portion of board 26, in the vicinity of engaging piece 28b, and as door 12 is closed, the actuator of switch 44 is pressed by hook 20b.

Figure 3:
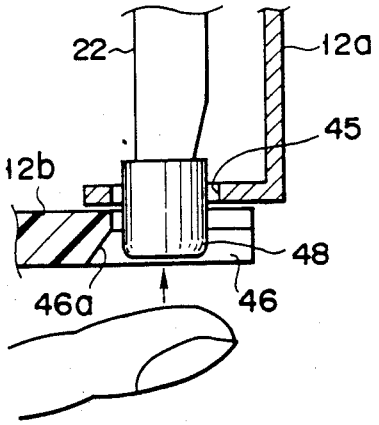
Figure 4:
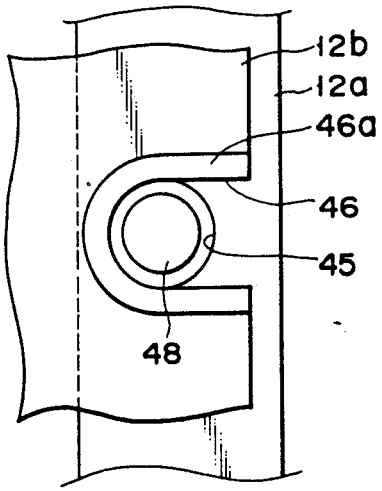

As is shown in FIGS. 2 to 4, the lower end of coupling lever 22 inside door 12 extends to the bottom portion of the door. At the bottom of door 12, baseplate 12a and faceplate 12b vertically overlap each other, plates 12a and 12b being formed having openings 45 and 46, respectively, facing the lower end of lever 22. Push button 48, which is fitted on the lower end of lever 22, is inserted in openings 45 and 46. When door 12 is in the closed state, the bottom surface of button 48 is situated just inside or above that of faceplate 12b. Opening 46 is formed by cutting the end edge of faceplate 12 into the shape of a U. Inner peripheral surface 46a of opening 46 is tapered, that is, spread downward. Button 48 and opening 46 are sized so as to fit the tip of a finger of an operator.

Push button 48 and coupling lever 22 together constitute second release mechanism 50 which permits manual unlocking of door 12.

As is shown in FIG. 2, push rod 33 and spring 35 are attached to the upper portion of door 12. The distal end of rod 33 abuts against the front face of body 10. Spring 35 urges rod 33 toward body 10. When door 12 is released from its locked state, it is immediately opened by the urging force of spring 35 exerted through the medium of push rod 33.

The following is a description of a control circuit for controlling the operation of first release mechanism 30.

Figure 5:
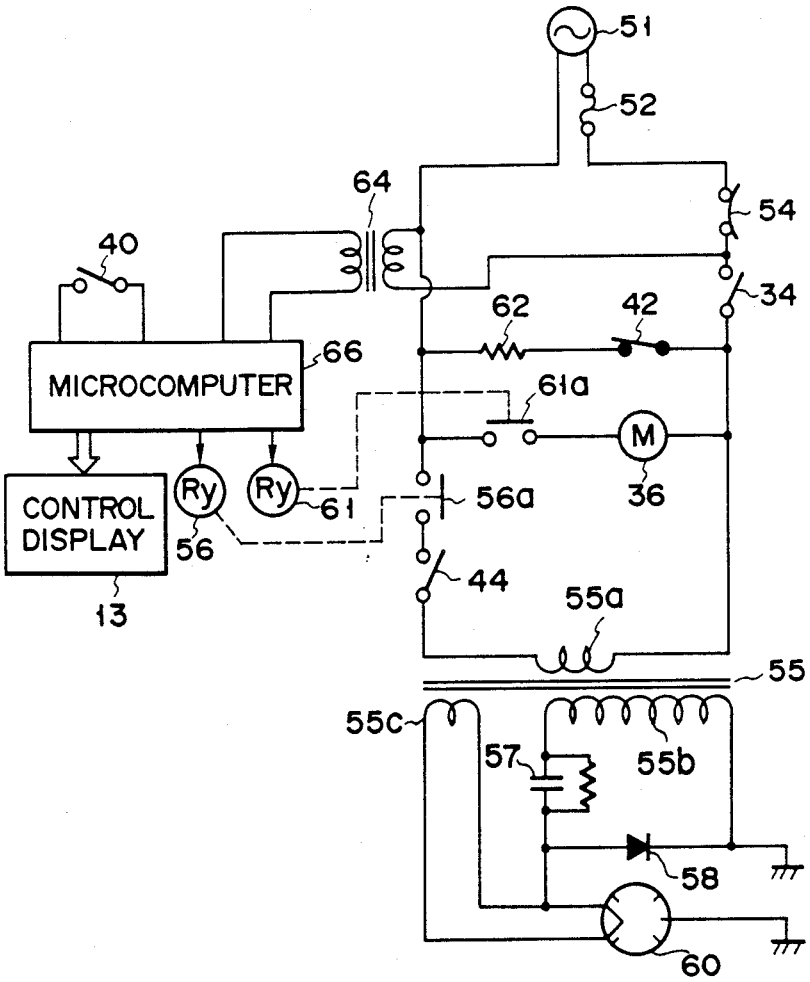

As is shown in FIG. 5, the control circuit comprises commercial AC power source 51. One end of primary coil 55a of high-voltage transformer 55 is connected to one end of power source 51 via fuse 52, magnetron thermal 54, and first door switch 34. The other end of coil 55a is connected to the other end of power source 51 via second door switch 44 and relay contact 56a.

An anode-cathode circuit of magnetron 60 is connected to secondary coil 55b of high-voltage transformer 55 via a half-wave voltage doubler rectifier which is composed of high-voltage capacitor 57 and high-voltage diode 58. The anode of magnetron 60 is grounded, while the cathode or heater is connected to secondary coil 55b of transformer 55.

In addition, one end of motor 36 is connected to one end of power source 51 via fuse 52, magnetron thermal 54, and first door switch 34, while its other end is connected to the other end of power source 51 via relay contact 61a.

Further, one end of door monitor switch 42 is connected to one end of power source 51 via fuse 52, magnetron thermal 54, and first door switch 34, while its other end is connected to the other end of power source 51 via resistor 62.

A primary coil of step-down transformer 64 is connected to power source 51 via fuse 52 and magnetron thermal 54, while a secondary coil of transformer 64 is connected to microcomputer 66.

Microcomputer 66, which controls all the operations of microwave oven, is externally connected to relays 56 and 61, switch 40 for cam position detection, and control display panel 13.

The following is a description of the operation of the microwave oven constructed in this manner.

Foodstuff is placed in heating compartment 11, and door 12 is then closed, whereupon, hooks 20a and 20b engage engaging pieces 13a and 13b, as is shown in FIG. 2, so that door 12 is locked in the closed position.

At this time, hook 20a presses lever 40, to thereby push the actuator of door monitor 42, while hook 20b presses the actuator of second door switch 44. In addition hook 20a forces down push lever 32, whereupon lever 32 presses the actuator of first door switch 34.

As a result of the above, first and second door switches 34 and 44 are turned on, while door monitor switch 42 is turned off.

In this state, desired cooking conditions are set, and the microwave oven is actuated to start cooking, by pressing condition setting keys 14 of control display panel 13.

Thereupon, microcomputer 66 energizes relay 56. Accordingly, contact 56a is closed, so that magnetron 60 is oscillated. As a result, high-frequency radio waves are supplied from magnetron 60 to heating chamber 11, thus starting the cooking operation.

When the stop key, which is included among setting keys 14, is operated to stop the cooking operation, or when the period of time set by a timer switch (not show) is elapsed, microcomputer 66 de-energizes relay 56, as a result of which contact 56a is opened, and magnetron 60 ceases oscillating, and thus, the cooking operation is completed.

Figure 6:
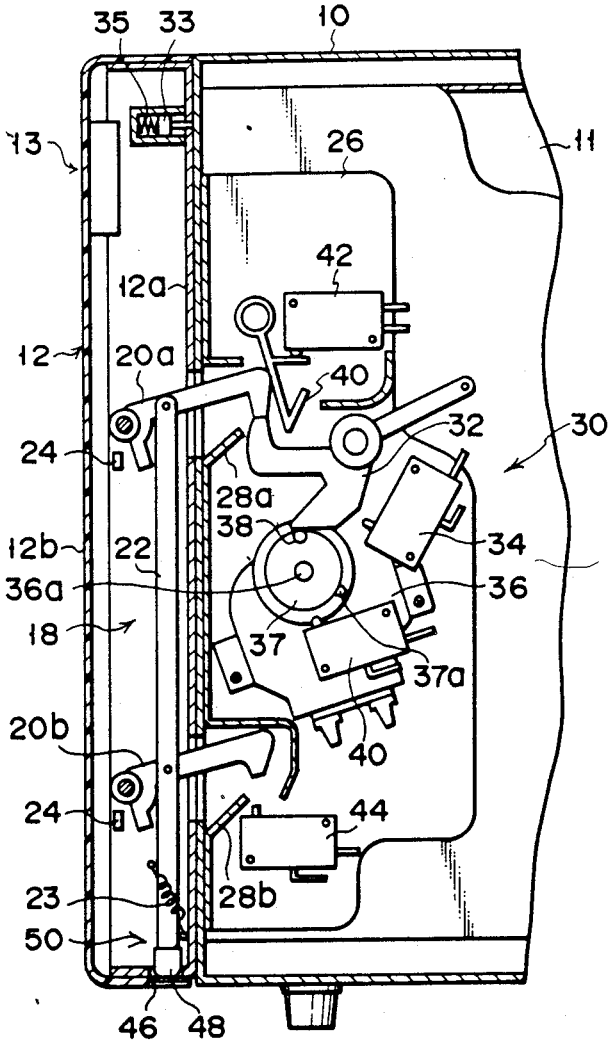
Figure 7:
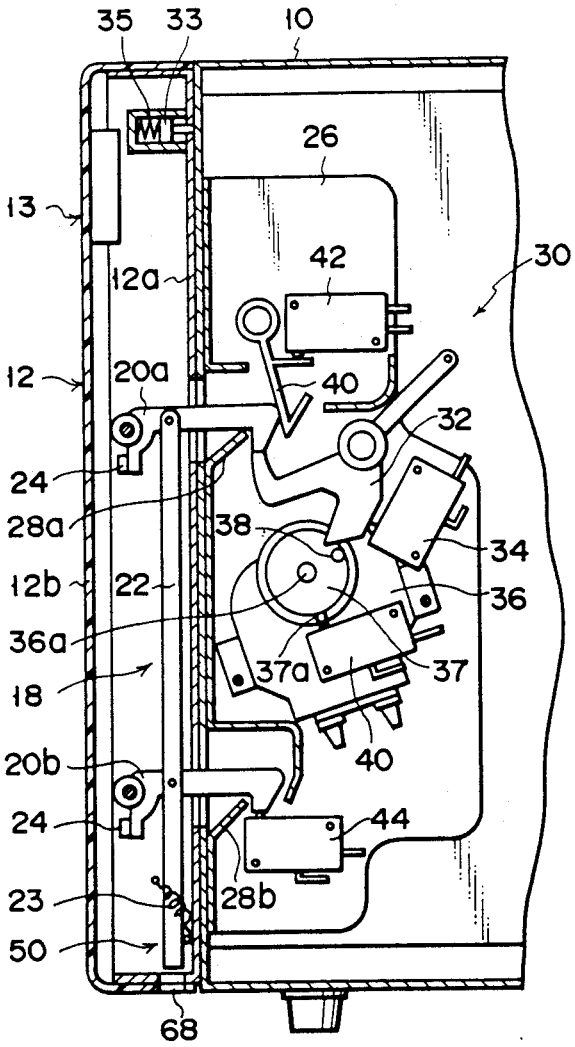

When, after completion of the cooking operation, the user touches door open key 15 in order to remove the foodstuff from heating compartment 11, microcomputer 66 energizes relay 61. Thereupon, contact 61a is closed, and motor 36 is actuated, causing cam 37 to rotate in the clockwise direction, so that, as is shown in FIG. 6, pin 38 forces up push lever 32. As a result, hook 20a is forced up by lever 32, is rocked upward in the counterclockwise direction, and is disengaged from engaging piece 28a. Simultaneously, hook 20b is rocked upward by the action of coupling lever 22, and disengaged from engaging piece 28b. In this manner, door 12 is released from its locked state, whereupon it is immediately opened by the combined action of push rod 33 and spring 35.

At this point, microcomputer 66, which detects the rotational position of cam 37 by means of switch 40, de-energizes relay 61 to stop the operation of motor 36 once cam 37 has completed one revolution.

In this way, door 12 is opened smoothly assuredly.

When, on the other hand, the microwave oven is not connected to a power supply, due, for example, to an interruption in the power supply or it being on display in a showroom, motor 36 then cannot be actuated to open door 12 by door open key 15 being touched.

In such circumstances, fingertip pressure against push button 48, located in opening 46, can be used to force up the button, as is shown in FIG. 3, which results in a hoisting force being applied to coupling lever 22, thereby raising it. As a result hooks 20a and 20b both rock upward and are disengaged from their corresponding engaging pieces 28a and 28b. The moment these elements are disengaged, door 12 is opened by the combined action of push rod 33 and spring 35.

Since hooks 20a and 20b can thus be disengaged by fingertip pressure, this ensures that door 12 can be quickly and easily opened for the removal of foodstuff from the heating compartment in the event of an interruption in the power supply.

The microwave oven constructed according to the above embodiment is, as has been stated earlier, provided with first release mechanism 30 for electromotively releasing door 12 from its locked state simply by way of touching door open key 15.

In addition, the microwave oven of this embodiment is provided with second release mechanism 50, constituted by push button 48 and coupling lever 22, which permits manual unlocking of door 12. Therefore, even when the oven is not connected to a power supply, the door can still be opened easily and assuredly, by means of fingertip pressure applied to push button 48. Thus, since the oven door can be opened without the oven having to be connected to a power supply, this contributes to greater safety when the inside of heating compartment 11 is to be cleaned, for example. Moreover, when the microwave oven is still on display in a showroom, door 12 can be opened this way, to enable prospective purchasers to view the interior of compartment 11. This opening method also permits routine maintenance, inspection, repairs, door switch adjustment, etc. to be effected with ease.

Push button 48 for actuating second release mechanism 50 is provided at the bottom of door 12, just inside the door. Since, therefore, the button is not normally visible, this results not only in the microwave oven of this embodiment being neater in its external design than a conventional oven, which may have a handle or push switch on the front of the door, but because it has no projecting members formed on its surface, the overall structure of the oven is also more compact.

Further, push button 48 is attached directly to coupling lever 22 for rocking hooks 20a and 20b, this means that lever 22 can be operated directly by means of button 48, so that a link mechanism, rocking arm, or any other interposal member does not have to be provided between these two parts. Thus, the microwave oven can be simplified in its construction and reduced in size.

As described above, push button 48 is situated just inside door 12. Thus, regardless of the shortness of the support legs of body 10 and the consequent narrowness of the gap between the bottom of door 12 and the surface of a table on which the microwave oven is placed, fingertip pressure can still easily be applied to button 48, making manual opening of the oven door easy to perform. Also, push button 48 can be prevented from being wrongly pulled. Further, since peripheral surface 46a of opening 46 is spread radially outward, the user's fingertip fits easily into opening 46 to press button 48, and button 48 can be pushed in to its full extent, without any risk of injury to the user.

Figure 8:
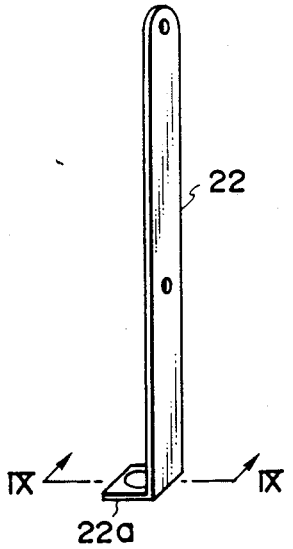
Figure 9:
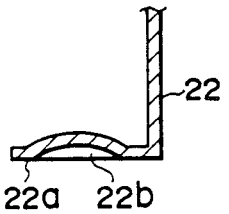
Figure 10:
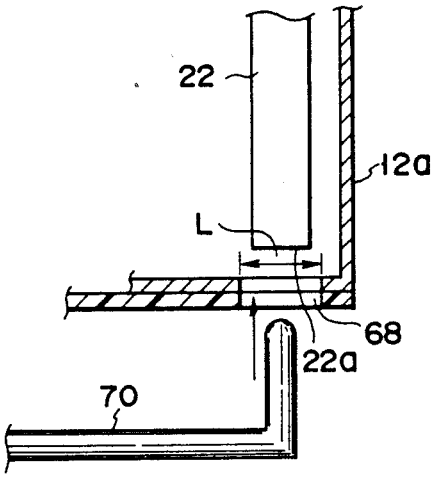

FIGS. 8 to 10 show a microwave oven according to a second embodiment of the present invention. This embodiment differs from the first embodiment only in the arrangement of second release mechanism 50. In the description to follow, like reference numerals are used to designate like portions, for simplicity.

In the second embodiment, coupling lever 22 extends to close to the bottom of door 12, and its lower end portion is bent in the shape of an L, thereby constituting tool receiver 22a. Receiver 22a is formed having a curved depression 22b for ease of engagement with attachment tool 70 used for manual opening of door 12, as will be described later. Through hole 68, through which attachment tool 70 passes, is formed in the bottom of door 12 such that it faces tool receiver 22a, and has a diameter L which is smaller than that of an average user's finger, to eliminate the risk of injury resulting from a finger being accidently inserted therein.

Attachment tool 70 is also L-shaped, and its distal end is rounded so as to engage similarly shaped depression 22b of tool receiver 22a. When not in use, tool 70 is detachably attached to a suitable portion of body 10.

When the microwave oven according to the second embodiment is not connected to a power supply, because of either an interruption in the power supply or it being on display, door 12 can then be opened, as is shown in FIG. 10, by the distal end portion of attachment tool 70 being inserted into door 12 through hole 68, such that it abuts against tool receiver 22a of coupling lever 22. Situated thus, tool 70 is manually forced up to raise lever 22, whereupon hooks 20a of 20b both rock upward and are disengaged from engaging pieces 28a and 28b, respectively. As a result, door 12 is unlocked and then immediately opened by the combined action of spring 35 and push rod 35.

Also in the second embodiment, as described above, the hooks can be disengaged mechanically by external operation using attachment tool 70, so that door 12 can be opened easily and securely even when power is off. Thus, the foodstuff can be securely taken out of the heating chamber, proving the same effect of the first embodiment.

Since diameter L of through hole 68 is smaller than that of the user's finger, moreover, the finger cannot be injured by being accidentally inserted into the hole. Furthermore, tool receiver 22b, having depression 22b in the lower end face of coupling lever 22, ensures reliable engagement between attachment tool 70 and lever 22.

It is to be understood that the present invention is not limited to the embodiments described above, and that various changes and modifications may be effected therein by one skilled in the art, without departing from the scope or spirit of the invention.

For example, in the first embodiment, push button 48 may be arranged such that its bottom surface is situated on the same plane as the bottom surface of faceplate 12b or slightly projects therefrom. The drive source for the first release mechanism is not limited to a motor, and a combination of a solenoid and a plunger may be used for this purpose.

What is claimed is:

1. A door lock/unlock apparatus of a cooker including a body having a heating compartment therein, and a door attached to the body, for opening and closing the heating compartment, said apparatus comprising:

a lock mechanism for locking the door in a closed position, said mechanism including an engaging portion coupled to the body and an engaging member attached to the door and movable between a release position and an engaged position where the engaging member can engage the engaging portion to keep it from opening in the closed position of the door;

first release means for electromotively releasing the lock mechanism when the door is to be opened; and second release means for releasing the lock mechanism by receiving an external mechanical force when the door is to be opened, said second release means including an opening formed at the door, and a coupling member arranged within the door and coupled to the engaging member so as to be movable integral with the engaging member, said coupling member having an operating portion situated in the vicinity of the opening so as to be operable through the opening.

2. An apparatus according to claim 1, wherein said opening is formed at the bottom of the door.

3. An apparatus according to claim 1, which further comprises opening means, provided on the door, for urging the door open.

4. An apparatus according to claim 1, wherein said second release means includes an attachment tool formed such as to be able to act on the operating end of the coupling member through the opening.

5. An apparatus according to claim 4, wherein said operating end of the coupling member has a tool receiving portion opposed to the opening, and a depression formed in the tool receiving portion and able to engage the attachment tool.

6. An apparatus according to claim 4, wherein said opening is sized such that an operator's finger cannot fit therein.

7. An apparatus according to claim 1, wherein said second release means includes a push button attached to the operating end of the coupling member and passing through the opening so as to be externally pressable.

8. An apparatus according to claim 7, wherein said push button is situated near the bottom of the door.

9. An apparatus according to claim 8, wherein said push button is situated just inside the bottom of the door with respect to the opening.

10. An apparatus according to claim 9, wherein said opening has an inwardly tapered peripheral surface.

11. An apparatus according to claim 1, wherein said first release means includes an electromotive source and a release mechanism arranged between the electromotive source and the engaging portion, for receiving operating power form the electromotive to move the engaging member, in engagement with the engaging portion, to the release position, when the electromotive source is actuated.

12. An apparatus according to claim 11, wherein said electromotive source includes an electric motor, and said first release mechanism includes a cam rotated by the motor and a push lever having a first end portion adapted to engage the engaging member when the door is closed, and a second end portion capable of engaging the cam, said push lever moving the engaging member to the release position in association with the rotary motion of the cam.

13. An apparatus according claim 11, wherein said first release means includes a control switch on the front face of the door and a driver circuit for actuating the electromotive source, in response to a shifting of the control switch when the engaging member is in engagement with the engaging portion.

* * * * *